US006070268A

United States Patent [19]

Holland

[11] Patent Number: 6,070,268

[45] Date of Patent: Jun. 6, 2000

[54] 1-2-3 BIB (QUICK/EASY/DISPOSABLE)

[76] Inventor: Joann Theresa Holland, 2455 E. 27th St., Brooklyn, N.Y. 11235

[21] Appl. No.: 09/272,422

[22] Filed: Mar. 19, 1999

[51] Int. Cl.[7] ..... A41B 13/00

[52] U.S. Cl. ..... 2/49.1; 2/49.4

[58] Field of Search ..... 2/49.1, 49.4

[56] References Cited

U.S. PATENT DOCUMENTS

| | | | |
|---|---|---|---|
| D. 238,521 | 1/1976 | Andersson . | |
| 686,631 | 11/1901 | McCathie . | |
| 889,073 | 5/1908 | Walbridge . | |
| 2,164,369 | 7/1939 | Woolever . | |
| 2,763,867 | 9/1956 | Chagnon . | |
| 3,299,440 | 1/1967 | Grable . | |
| 3,332,547 | 7/1967 | Rowe et al. . | |
| 3,979,776 | 9/1976 | Gruenwald | 2/49.1 |
| 4,442,552 | 4/1984 | Bolick et al. | 2/49.1 |
| 4,884,299 | 12/1989 | Rose | 206/390 |
| 5,530,968 | 7/1996 | Crockett | 2/46 |
| 5,661,851 | 9/1997 | Sanchez | 2/49.4 |
| 5,672,056 | 9/1997 | Fisher et al. | 433/137 |
| 5,802,610 | 9/1998 | Burr | 2/49.4 |
| 5,809,568 | 9/1998 | Morris-Jones | 2/49.1 |

*Primary Examiner*—John J. Calvert
*Assistant Examiner*—Shirra L. Jenkins

[57] ABSTRACT

A disposable bib having a first plastic liner layer, a second single ply cotton tissue layer, a third fiber cotton filling layer, a fourth single ply cotton layer and a fifth single ply cotton tissue layer. The bib further includes a convex upper and lower portion and concave middle portions as well as a cross cut neck opening.

5 Claims, 2 Drawing Sheets

1-2-3 BIB (QUICK/EASY/DISPOSABLE)

BACKGROUND OF THE INVENTION

I thought of this 1-2-3 BIB (Quick/Easy/Disposable) while feeding my baby. I live in a small apartment and do not have a washing machine or dryer. As a mother, I found myself carrying both the baby and the heavy laundry to the Laundromat. Thinking there must be a better way, I came up with the ides that a 1-2-3 BIB (Quick/Easy/Disposable) would help keep the kids clothes clean, and I would not have to wash these bibs. My first idea came about the beginning of October 1998 on a cold evening at the Laundromat. I started with the idea of the 1-2-3 BIB (Quick/Easy/Disposable) by cutting up a disposable diaper in the shape of a bib. This bib I developed was too thick, clumsy and uncomfortable for the baby. This gave me the idea of a light plastic backing with a cotton filling, topped with a two ply cotton tissue. A simple pull-over seems like an easy way. The bib has an upper middle cross cut that is stitched on each side of the cross cut. This leaves an opening for the baby's head to pass through. The bib also contains a perforated line on the upper left side portion for easy tear off and disposing. I designed the 1-2-3 BIB (Quick/Easy/Disposable) out of pure need.

As a mother, it is very hard to keep the baby still while trying to snap or tie on a bib. The idea of a cross cut came to me when I was thinking there must be a better way than tape or ties. A simple pullover seems like an easy way. I believe that this 1-2-3 BIB (Quick/Easy/Disposable) would be a great help for all family members.

The purpose of the 1-2-3 BIB (Quick/Easy/Disposable) is to provide a baby bib that gently keeps a baby's clothes clean which also is water absorbent, disposable, soft and easy to remove after use. The bib can be used at home, while visiting family and friends, in restaurants and while traveling.

DETAILED DESCRIPTION OF THE DRAWINGS

Figure 1:
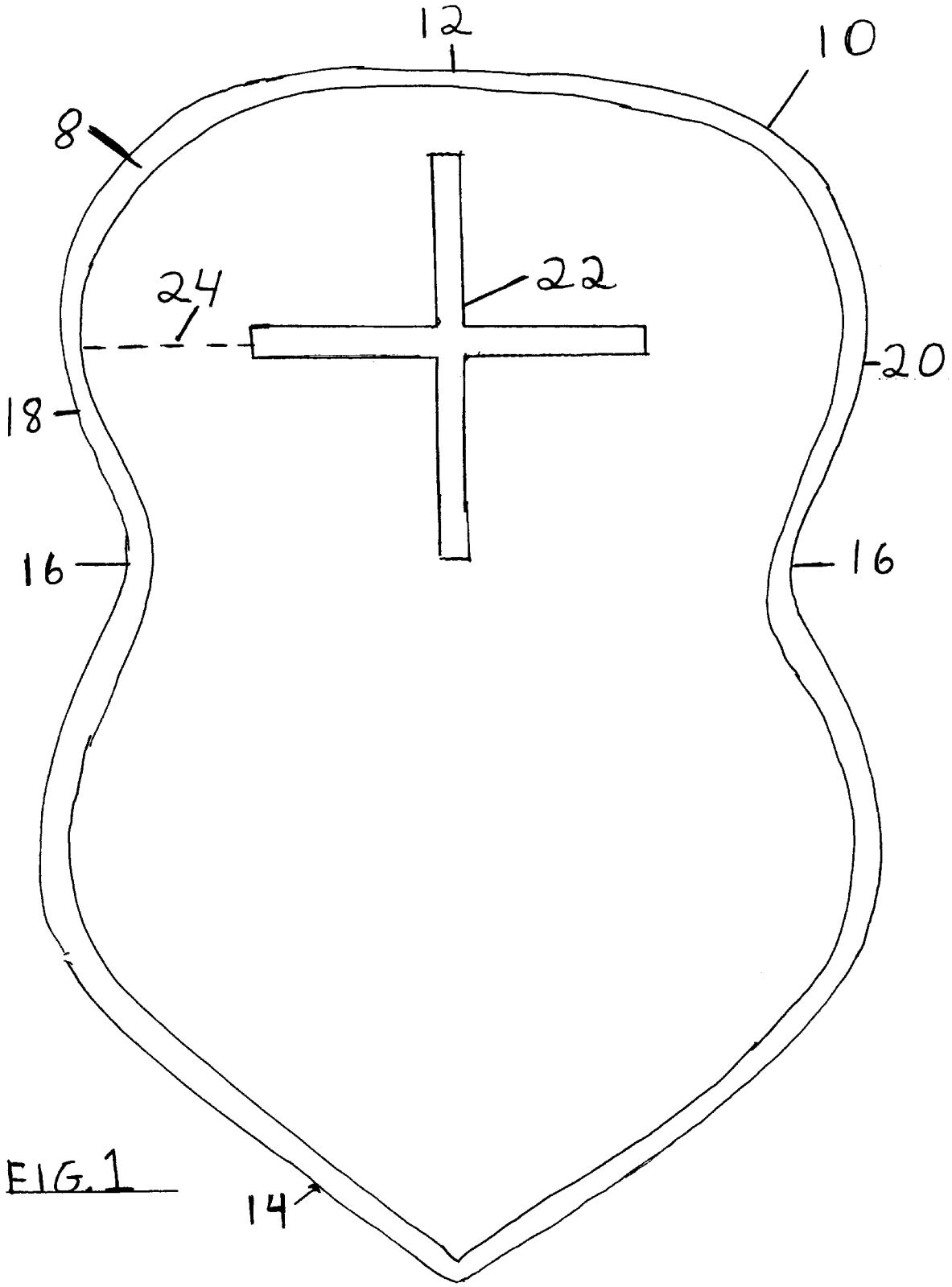
FIG. 1 is a front view of the bib of the present invention

The bib 10 shown in FIG. 1, has a convex upper portion 12 and a convex lower portion 14 and concave middle portions 16 on either side 18 and 20. The entire outer periphery of the bib 10 is provided with a binding material 8 which is attached by sewing and secures the layers of the bib together. A neck opening 22 is provided by a cross cut area located near the distal end of the upper portion 12. This cross cut neck opening 22 penetrates through all layers of the bib. The bib also is provided with a line of perforation 24 which extends from one arm of the cross cut neck opening to a perimeter of one of the sides 18 or 20 of the bib. The line of perforations also penetrates through all the layers of the bib. This allows the bib to be readily removed from the wearer by tearing the line of perforation 24 after use and sliding the bib from around the wearer's neck. This prevents the bib from having to be slipped back over the head of the wearer after use. Although the bib can be provided with any suitable dimensions, it is suggested that the entire bib be fourteen inches in length with the upper portion having a width of eleven inches, the middle concave portion having a width of nine inches, the lower portion having a width of ten inches. The length of the cross cut neck opening should be approximately six inches and the length of the line of perforation should be approximately two inches.

Figure 2:
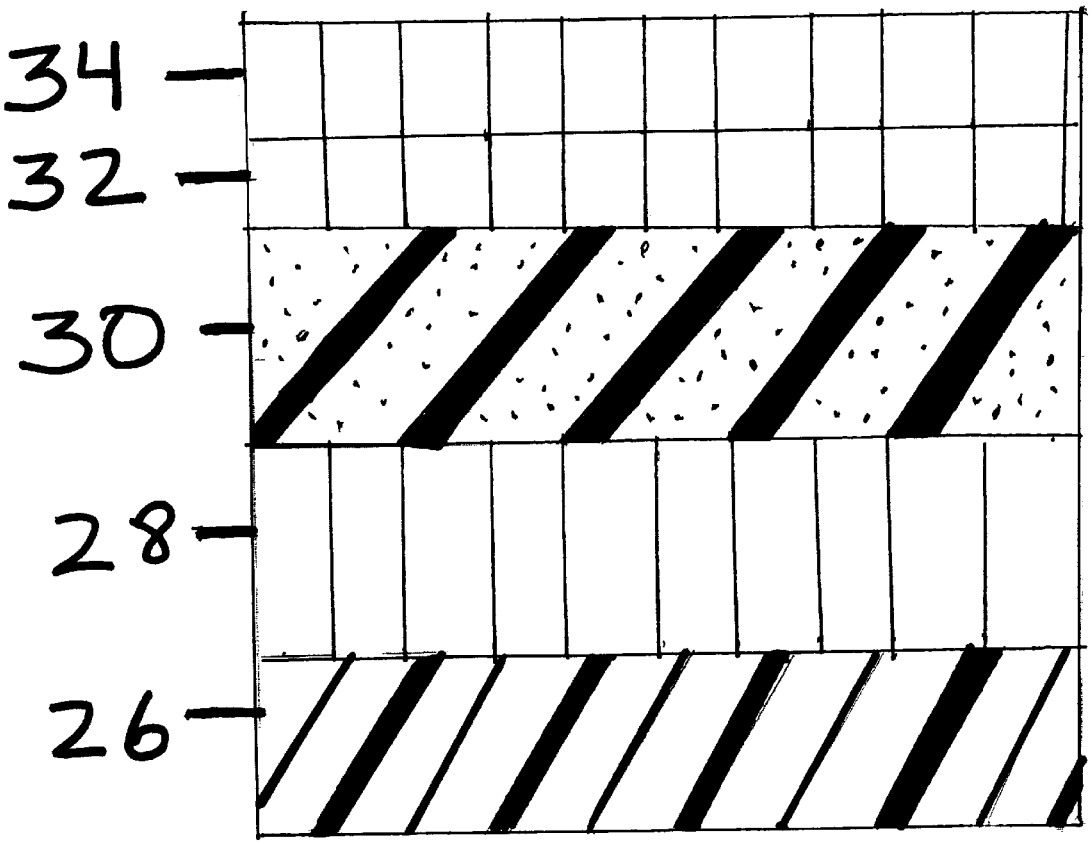
FIG. 2 is a cross sectional view of the bib

FIG. 2 shows the layers of the bib in greater detail. The first, bottom most layer 26, that is the layer which comes in contact with the wearer when the bib is in use, is a plastic liner material. The next or second layer 28 is a single ply cotton tissue type material. The third layer 30 is a cotton fiber filling and the fourth 32 and fifth 34 layers are both single ply cotton tissue.

What is claimed is:

1. A disposable bib comprising:

a first plastic liner layer, a second single ply cotton tissue layer, a third fiber cotton filling layer, a fourth single ply cotton tissue layer and a fifth single ply cotton tissue layer arranged such that the first plastic liner layer is disposed closest to the wearer and the fifth layer is disposed furthest from the wearer in order to allow food or liquid which may be spilled during use to be readily absorbed by the fifth layer while the first layer prevents food or liquid from soiling the wearer.

2. The disposable bib as claimed in claim 1, wherein the bib includes a convex upper portion and a convex lower portion and concave middle portions.

3. The disposable bib as claimed in claim 1, wherein the bib includes a binding which is attached to the outer periphery of the bib by sewing.

4. The disposable bib as claimed in claim 1, wherein the bib includes a cross cut neck opening which penetrates all layers of the bib.

5. The disposable bib as claimed in claim 4, wherein the bib includes a line of perforation which penetrates all layers of the bib and extends from the neck opening to a side of the bib for ease in removal of the bib.

* * * * *